United States Patent [19]

Sabin et al.

[11] Patent Number: 4,974,419

[45] Date of Patent: Dec. 4, 1990

[54] APPARATUS AND METHOD FOR SIMULTANEOUSLY HEATING AND COOLING SEPARATE ZONES

[75] Inventors: Cullen M. Sabin, San Diego; Dennis A. Thomas, Los Angeles; Gary V. Steidl, Encinitas, all of Calif.

[73] Assignee: Liquid $CO_2$ Engineering Inc., Los Angeles, Calif.

[21] Appl. No.: 169,869

[22] Filed: Mar. 17, 1988

[51] Int. Cl.[5] ..... F25B 15/00

[52] U.S. Cl. ..... 62/101; 62/477

[58] Field of Search ..... 62/101, 10.6, 293, 294, 62/4, 457, 371, 372, 238.3, 477; 126/263

[56] References Cited

U.S. PATENT DOCUMENTS

| | | | |
|---|---|---|---|
| 2,144,441 | 1/1939 | Schlumbohm . | |
| 3,316,736 | 5/1967 | Biermann . | |
| 3,642,059 | 2/1972 | Greiner | 62/476 |
| 3,726,106 | 4/1973 | Jaeger . | |
| 3,950,960 | 4/1976 | Kawam . | |
| 3,967,465 | 7/1976 | Asselman et al. . | |
| 3,970,068 | 7/1976 | Sato . | |
| 4,126,016 | 2/1972 | Greiner . | |
| 4,205,531 | 6/1980 | Brunberg et al. | 62/477 |
| 4,250,720 | 2/1981 | Siegel . | |
| 4,682,476 | 7/1987 | Payre et al. . | |
| 4,736,599 | 4/1988 | Siegel . | |

FOREIGN PATENT DOCUMENTS

| | | |
|---|---|---|
| 2095386 | 9/1982 | United Kingdom . |

*Primary Examiner*—Henry A. Bennet

*Attorney, Agent, or Firm*—Knobbe, Martens, Olson & Bear

[57] ABSTRACT

Disclosed is a device for simultaneously heating and cooling adjacent food portions. A first module defining a first hollow chamber is formed into a substantially planar surface for supporting the food portion to be cooled. The first chamber contains a vaporizable substance in equilibrium with vapor. A second module defining a second hollow chamber is likwise formed into a substantially planar surface for supporting the food portion to be heated. The second chamber contains a sorbent and is evacuated. The chambers are fluidly interconnected by a conduit having a normally closed valve to prevent egress of vapor from the first chamber. In use, the valve is open, allowing vapor from the first chamber to flow into the evacuated second chamber. The resulting drop in pressure allows the vaporizable substance in the first chamber to change phase into vapor, thereby cooling the first chamber and its associated food portion. Moisture in the vapor entering the second chamber is absorbed by the sorbent, which evolves chemical reaction heat, thereby heating the second chamber and its associated food portion. The first and second modules of the present invention may be conveniently placed in adjoining pockets of a foam container for containing the cold and hot portions of a sandwich or other fast food.

39 Claims, 2 Drawing Sheets

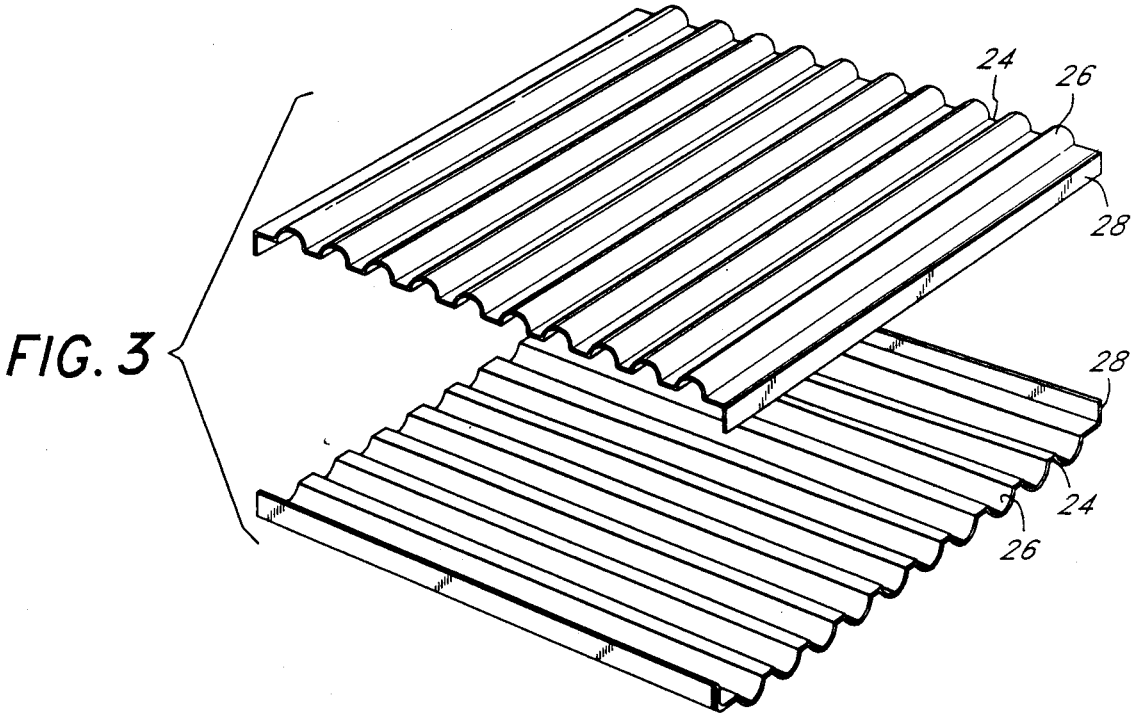
FIG. 3
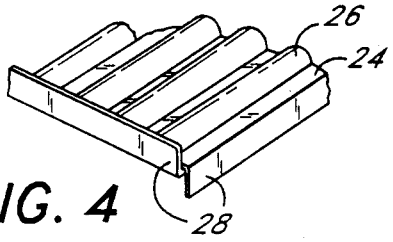
FIG. 4
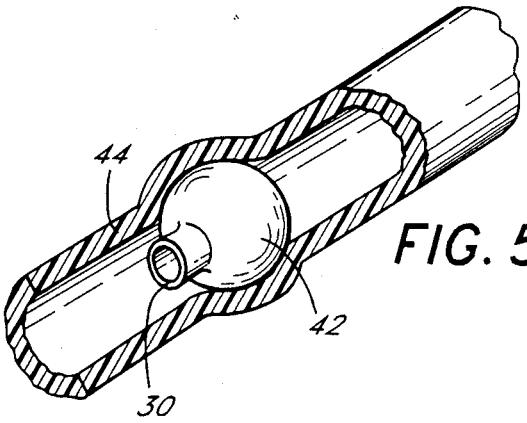
FIG. 5
FIG. 6
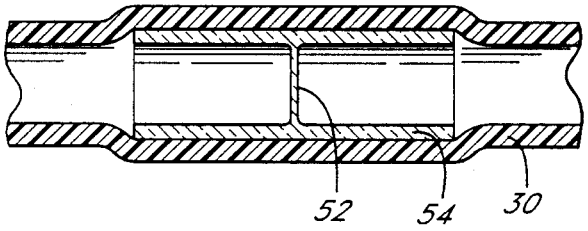

APPARATUS AND METHOD FOR SIMULTANEOUSLY HEATING AND COOLING SEPARATE ZONES

BACKGROUND OF THE INVENTION

This application relates to copending application Ser. No. 070,973, filed July 7, 1987. The invention relates to temperature changing devices and, in particular, to portable or disposable devices for heating and cooling separate hot and cold portions of food.

In serving food it is preferable to maintain hot foods and cold foods in their respective states until consumption. It would be advantageous for restaurants to be able to provide complete meals, including a hot entree and vegetable and a cold salad, dessert and beverage, and provide means for heating the hot portion and cooling the cold portion.

Similarly, a single food item may comprise hot and cold portions, the temperature of which are preferably maintained until consumption. For example, fast food hamburgers often include, in addition to the bun, meat patty and condiments, various vegetables such as lettuce and tomato. It is deemed advantageous to keep the meat patty hot until consumption. However, prolonged exposure to heat tends to wilt lettuce and tomato, rendering them relatively unpalatable. Thus, it is also deemed advantageous to keep the lettuce and tomatoes cool until consumption. Therefore, to preserve the palatability of such a sandwich, it is logical to keep the components separated as long as possible, preferably until just before eating. On the other hand, because fast food restaurants are high-volume operations, the logic of palatability has traditionally taken a back seat to the expediency of volume. Since the dawn of fast food restaurants, hamburgers have been prepared ahead of time, leaving the meat patty to cool and the lettuce and tomato to heat. As a result, the consumer received a sandwich in which the components had reached a steady-state temperature throughout. The deleterious effects of allowing the meat patty to cool were somewhat overcome in the prior art by placing the entire sandwich in some type of heating device, usually under heat lamps or on a steam table. This method, however, exacerbated the problem of heating the lettuce and tomato.

Recently, one restaurant chain has attempted to overcome this problem with a hamburger sandwich served in a dual package. The package is a foam container, one side of which contains the hot meat on the lower half of the bun, and the other side of which contains the lettuce and tomato on the upper half of the bun. The stated objective of this arrangement is to keep the hot side hot, and the cool side cool.

To a certain extent, this arrangement is successful. Keeping the hot and cool components separate prevents direct heat transfer between the hot meat patty and the cool lettuce and tomato. Nevertheless, both sides of the sandwich come to room temperature within a short period of time. This is due to the relatively poor insulation afforded by the foam containers. Thus, unless such a sandwich is eaten soon after being placed in the container, it will be close to room temperature. This presents a problem for consumers unable to eat their sandwiches at the restaurant. For example, those who wish to eat in their cars, at beaches or at picnic areas must do so with a sandwich which is tepid at best.

One alternative method for maintaining the temperature of separate hot and cold portions of food would be to use containers made of better insulation. For example, the typical fast food package is made of foam, 0.070 inch thick. The insulation quality could be improved at the expense of both cost and space. Apparently, the industry has not found it feasible to improve the insulative quality of its packaging.

Moreover, foam packages are not biodegradable, and their perpetual existence has led legislatures in several states to consider banning their use. These environmental concerns are not the least of the drawbacks of foam containers.

Accordingly, in food serving in general, and fast food serving in particular, there has existed a long-standing need for a relatively small, inexpensive device to maintain the temperature of separate hot and cold portions of food.

The use of two chambers to produce a cooling effect around one chamber is illustrated in U.S. Pat. No. 4,250,720 to Siegel and Great Britain Patent No. 2,095,386 to Cleghorn, et al. These patents disclose a two-chamber apparatus connected by a tube. One chamber contains a refrigerant liquid and the other contains a sorbent. Fluid communication between the two chambers is selectively allowed by a valve in the tube. The Siegel patent uses water as the refrigerant liquid, while the Cleghorn, et al. patent is not limited to water. The Siegel patent envisions the use of such a cooling device to cool food or beverages.

The prior art temperature changers, as exemplified by the Siegel and Cleghorn, et al. patents, contemplate a device for either heating or cooling. In a cooling device, the heat generated by the sorbent is waste heat. Likewise, in a heating device, the refrigeration accomplished by the liquid is wasted.

Furthermore, none of the prior art patents disclose a structure suited for simultaneously heating and cooling separate hot and cold portions of food. Rather, the structures are primarily devoted to the heating or cooling of a single portion See Siegel FIGS. 2–4. Moreover, none of the prior art structures particularly address the problems encountered in using a device which is inexpensive and disposable to heat and cool separate hot and cold portions of food. For example, the prior art envisions use of rigid containers for both the liquid and sorbent. Such rigid containers may be relatively expensive and potentially prohibitive for disposable use in high-volume, low-margin operations such as fast food or other food operations.

SUMMARY OF THE INVENTION

The present invention is an inexpensive, disposable device for heating and cooling adjacent zones, comprising a first (cooler) module containing a vaporizable substance, a second (heater) module containing a sorbent for the vaporizable substance, a conduit connecting the first and second modules, and a valve in the conduit for selectively allowing flow through the conduit. In the preferred embodiment, the cooler module contains, as a vaporizable substance, water fixed in a distributed film by incorporation into a starch-acrylic water-fixing polymer. The polymerized water is contained in the preferred embodiment in a pouch formed of metal foil or metallized plastic film. The pouch is provided with means for preventing its vacuum-driven collapse, which would cut off vapor flow to the conduit. These support means may include structural elements within the pouch or forming the pouch surfaces so as to provide the required rigidity. The construction of the cooler module provides a substantially planar surface.

The heater module in the preferred embodiment is a pouch of metal foil or metallized plastic film sealed at the edges. The sorbent is formed into beads, which are rigid enough to support the upper layer against atmospheric pressure when the sorbent envelope is evacuated.

The conduit of the preferred embodiment of the present invention is a flexible tube connecting the heater and cooler modules. The valve is a normally closed single-use valve. Preferably, this valve comprises a frangible disc or hemisphere inserted into the tubing which can be activated by simply flattening the tubing to crush the barrier.

The device and method of the present invention finds particularly advantageous application in conjunction with a container for separate hot and cold portions of food such that in operation the heater module heats the hot portion and the cooler module cools the cold portion.

The device of the present invention enjoys several significant advantages. The sorbent of the preferred embodiment evolves heat in an amount greater than 1.5 times the heat content of the vapor. Thus, the amount of heat delivered to the hot side will be greater than 1.5 times the amount of heat removed from the cool side. This marked difference between the cooling rate and heating rate is preferred for food applications because, to the human senses, ambient food temperature is body temperature, 98.6° F., which is substantially higher than the ambient temperature of the usual environment.

The device is substantially self-regulating. At steady-state, the vaporizable substance evaporates at the rate set by heat leakage into the cold side of the container. The rate of vapor delivery to the sorbent sets the rate of energy release, and the temperature is limited by heat leakage out of the container.

These and other advantages and features of the present invention will become more fully apparent from the following description and appended claims taken in conjunction with the accompanying drawings.

BRIEF DESCRIPTION OF THE DRAWINGS

FIG. 3 is an exploded perspective view of one embodiment of the construction of the cooler module.

FIG. 4 is a perspective detail view of the corner of the cooler module embodiment of FIG. 3.

FIG. 5 is a partially sectional view of one preferred embodiment of the valve of the present invention.

FIG. 6 is a sectional view of another preferred embodiment of the valve.

DETAILED DESCRIPTION OF THE PREFERRED EMBODIMENT

Figure 1:
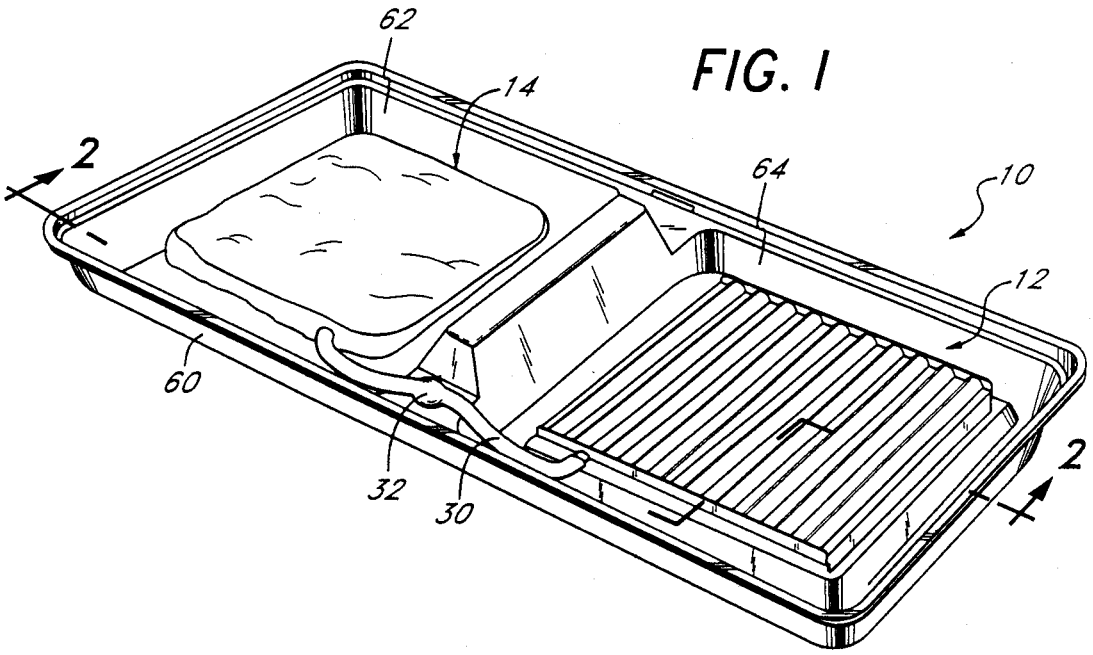
FIG. 1 is a perspective view of the apparatus of the present invention.
Figure 2:
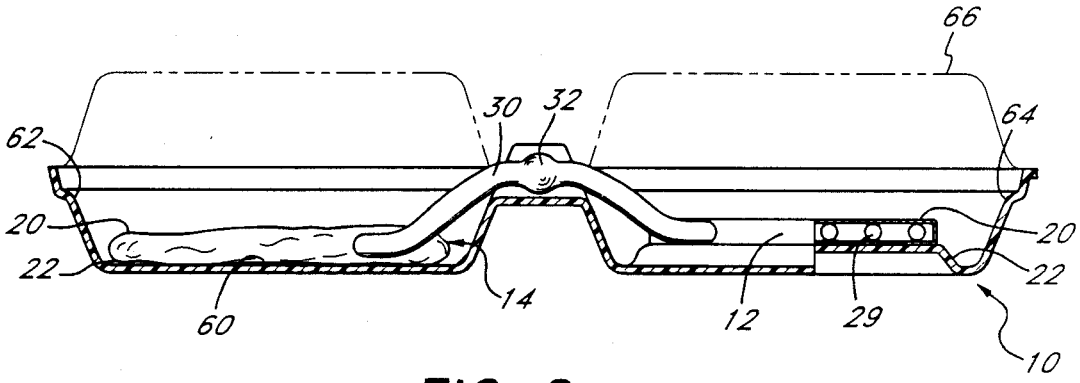
FIG. 2 is a partially sectional view taken along line 2—2 of FIG. 1.

Referring to FIGS. 1 and 2, the heating-cooling apparatus 10 has a first module 12 and a second module 14, both constructed of thin, flexible, thermally conductive material in an upper layer 20 and lower layer 22 which are bonded together at the edges to form a hermetically sealed substantially planar envelope. In a preferred embodiment, the thermally conductive material is a metal foil, such as one composed substantially of aluminum or copper, or a metallized plastic film, such as aluminized mylar. The edges of the material may be bonded together by any suitable means, including soldering, heat sealing, fold sealing and the use of adhesives. The material is preferably relatively thin, about 0.003 inch in thickness.

The first (cooler) module 12 contains a vaporizable substance which may be liquid, or in a preferred embodiment, may be fixed in a solid form by incorporation into another substance. Vapor is in equilibrium with the vaporizable substance at low pressure at ordinary ambient temperatures. The vaporizable substance may be water, and in a particularly preferred embodiment water is fixed into a distributed film or gel by incorporation into a starch-acrylic polymer, such as the material denominated by the trademark Water Lock Model J550 (Grain Processing Corporation, Muscatine, Iowa 52761).

The upper 20 and lower layers 22 of the cooler module 12 are provided with suitable means for supporting module 12 from vacuum-driven collapse so as to cut off the flow of vapor. Suitable means may include an internal structural lattice, mesh or other space-filling insert for separating the layers 20, 22 of module 12. On the other hand, the layers 20, 22 themselves may be configured to provide the necessary support. For example, as shown in FIGS. 1, 3–4, the upper 20 and lower layers 22 may be corrugated into alternating narrow strips 24 and flutes 26. The flutes 26 in this embodiment may be semicircular in cross-section. The upper and lower layers 20, 22 are fitted together with the concave surfaces of the flutes 26 facing inwardly so that communicating channels are formed within the cooler module 12 through which the vaporizable substance can circulate. In the embodiment shown in FIG. 3, the upper 20 and lower 22 layers are oriented so that the corrugation of one layer is substantially orthogonal to the corrugation of the other, so that all passages are interconnected into a single cavity without the necessity of providing header-tubes The edges of both layers that are parallel to the longitudinal axes of flutes 26 extend centrally in the assembled module 10 to form vertical flanges 28 and when the flutes 26 of the upper 20 and lower 22 layers lie perpendicular to each other, the vertical flange 28 of each layer covers the open ends of the flutes 26 of the other and may be fastened in place to hermetically seal the module 12. Non-reactive rigid beads 29 may be used to provide support for cooler module 12, either alone or, as shown in FIG. 2, in conjunction with the separate structural or integral means discussed above.

After cooler module 12 is assembled, air is evacuated so that the pressure within is the vapor pressure of the vaporizable substance The second (heater) module 14 is packed with a desiccant or sorbent material, after which it is evacuated. In a preferred embodiment, the sorbent is Multiform Type 4A desiccant (Multiform Desiccants, Inc., Buffalo, N.Y. 14213) in the form of 1/16 inch diameter beads. The sorbent within provides rigidity to heater module 14, and supports the upper 20 and lower layers 22 against atmospheric pressure after the module is evacuated. Thus, use of sorbent in bead form obviates the need for the structural features of the cooler module 12 Modules 12, 14 may also be constructed of sufficient rigidity to provide support on their top surfaces for objects, e.g., food portions, to be cooled and heated, respectively. In such case, heater module 14 may need additional structure to prevent collapse.

Referring to FIGS. 1 and 2, the heater 14 and cooler 12 modules are joined by a conduit 30 and a valve 32 interposed in conduit 30 allows fluid communication between modules 12, 14 and through conduit 30 only when valve 32 is open.

Conduit 30 between modules 12, 14 is preferably of flexible material such as heavy-walled tubing, such as plastic tubing, and resilient enough to remain patent without internal support.

The interposed valve 32 must have the capacity to isolate heater 14 and cooler 12 modules from each other so as to maintain a static condition from the time the apparatus is assembled until it is operated.

In order to do this, the closed valve 32 must maintain the pressure of water vapor in the cooler module 12 against the virtual vacuum of the heater module 14. Over the range of expected ambient temperatures, the pressure of water vapor would not be expected to exceed about 4 in. $H_g$ or 2 lbs per sq. in. in the cooler module 12. Such a pressure difference can be supported by a foil membrane or similar barrier. However, the apparatus can be operated more conveniently by providing a valve 32 of frangible material having a diameter large enough to form a sealing barrier within conduit 30, and contoured to be inserted easily into a short section of flexible tubing which serves as the conduit 30. To open valve 32, the conduit 30 tubing can be pressed flat to crush the barrier When released, the conduit 30 tubing regains its shape and patency to allow vapor to pass through. Examples of such frangible valves are a hollow glass sphere 42 (FIG. 5) or a brittle disk 52 in a hollow cylindrical body 54 (FIG. 6).

FIG. 5 shows a glass sphere 42 installed as a valve in heavy walled plastic tubing conduit 30. The sphere 42, which is open at one side 44 to permit evacuation of air, has a diameter slightly greater that of the inside diameter of the tubing in order to provide a tight seal Insertion of the sphere 42 and seating against the wall of the tubing is facilitated by first applying a film of lubricant to the sphere 42 or within the conduit 30 tubing. FIG. 6 shows the alternative frangible valve configuration, a hollow cylindrical glass tube 54 with a membrane occlusion 52.

The entire assembly 10 can be disposed of after a single use. After assembly and prior to its use, the heating-cooling apparatus 10 is in a static condition with the heater module containing the sorbent evacuated and the cooler module containing water vapor in equilibrium with water. The two modules 12, 14 are isolated from each other by means of a closed, single use valve 32 within the conduit 30 between them.

The operation of the device 10 is initiated when the valve 32 is opened. Opening valve 32 between the heating 14 and cooling 12 modules causes a drop in pressure in the cooling module 12 because vapor in the cooling module 12 flows through conduit 30 into the evacuated heating module 14. This drop in pressure causes the liquid in the cooling module to boil at ambient temperature generating additional vapor. This liquid-to-gas phase change can occur only if the liquid absorbs a quantity of heat equal to the latent heat of vaporization of the evaporated liquid from the cooling module 12. This process causes the temperature of the cooling module 12 to drop. The cooling module, in turn, removes heat from its environment, including substances with which it is in contact or proximate.

Operation of the device not only refrigerates the cooler module 12 by evaporation but at the same time heats the heater module 14 by combined condensation energy and heat of chemical reaction of vapor with the sorbent. Vapor produced in the cooler module 12 flows into the heater module 14 following the pressure gradient. Within the heater module 14, the water vapor is absorbed or adsorbed by the sorbent in an exothermic process in which the heat evolved is roughly (in view of various heat transfer gains and losses of the process) equivalent to the heat of vaporization absorbed in the cooler module during the corresponding liquid-to-gas phase change. Further, according to the invention, the sorbent selected may also be a substance which is also capable of chemically reacting with water in an exothermic reaction. This chemical reaction together with physical absorption or adsorption releases a quantity of heat in the heater module 14 which is greater than the heat absorbed by the cooler module 14 to vaporize the quantity of water taking part in the reaction. The net effect is that the temperature gradient with respect to ambient temperature in the heater module 14 is greater than that in the cooler module 12.

The operation of the device is self-regulating. After a short transition period, a steady state condition is reached in which the heating 14 and cooling 12 modules and the volumes that make up their environments remain at a constant temperature for a period of time. As the water in cooling module 12 vaporizes and escapes, module 12 cools. As it cools, the rate of vaporization decreases and vapor pressure within the cooling module 12 falls, slowing the transfer of water vapor to the heater module 14. Within the heater module 14, absorption of water vapor by the sorbent releases heat. As the temperature of the heater module 14 rises, the volume of free, non-absorbed water vapor in module 14 expands and creates a counter pressure against the vapor pressure of cooler module 12, also slowing the transfer of water vapor into heater module 14, and consequently slowing the heat producing reactions, and stabilizing the temperature. As heat is transferred from heater module 14 into its surroundings, its internal temperature falls, and the volume of the free, non-absorbed vapor within it contracts, drawing more vapor from cooling module 12, which cools, and into the heater module 14 which generates additional heat when the vapor reacts with the sorbent.

If air is present in the modules, it dilutes the vapor, reducing the temperature gradients of both modules, and decreasing the efficiency of self-regulation. For this reason, air is preferably evacuated from the assembly before operation.

The important components of the present invention are the vaporizable substance and the sorbent. The vaporizable substance and the sorbent must be complementary (i.e., the sorbent must be capable of absorbing or adsorbing the vapor produced by the vaporizable substance), and suitable choices for these components would be any combination able to make a useful change in temperature in a short time, meet government standards for safety, and be compact.

The vaporizable substances used in the present invention preferably have a high vapor pressure at ambient temperature, so that a reduction of pressure will produce a high vapor production rate. The vapor pressure at 20° C. is preferably at least about 9 mm Hg, and more preferably is at least about 15 or 20 mm Hg. Moreover, for some applications (such as cooling of food products)

the vaporizable substance should conform to applicable government standards in case any discharge into the surroundings, accidental or otherwise, occurs. Liquids with suitable characteristics for various uses of the invention include various alcohols, such as methyl alcohol and ethyl alcohol; ketones or aldehydes, such as acetone and acetaldehyde; water; freons, such as freon C318, 114, 21, 11, 114B2, 113, and 112; acetone dimethyl ketal; chlorocarbon compounds, such as allyl chloride, ethyl chloride, ethylene chloride, methylene chloride, boron trichloride, and methyl chloride; carbon disulfide; hydrogen sulfide; and other hydrocarbon compounds, such as isoprene, carbon suboxide, butane, and cyclobutene.

The sorbent material used in heater module 14 is preferably capable of absorbing or adsorbing all the vapor produced by the vaporizable substance, and also preferably will meet government safety standards for use in an environment where contact with food may occur. Suitable sorbents for various applications may include barium oxide, magnesium perchlorate, calcium sulfate, calcium oxide, activated carbon, calcium chloride, glycerine, silica gel, alumina gel, calcium hydride, phosphoric anhydride, phosphoric acid, potassium hydroxide, sulfuric acid, lithium chloride, ethylene glycol, and sodium sulfate.

The composition of the sorbent determines the ratio between the heat generated in heater module 14 and the heat absorbed in cooler module 12.

In a preferred embodiment, molecular sieve Multiform Type 4A desiccant generates 1.8 times the heat content of water vapor it absorbs, and a drop of 30° F. in the cooler module is accompanied by a rise of 54° F. in the heater module. The match of hot and cold temperature levels is ideal for preparing combinations of foods that are customarily served heated and chilled. Given a standard ambient temperature of 75° F., when the heater module 14 reaches an equilibrium temperature of 129° F., the cooler module 12 reaches an equilibrium temperature of 45° F. Food chilled to 45° F. is palatably cold and food heated to 129° F. is palatably warm, but not unpleasantly hot. The disparity between the ambient-cold and ambient-hot differences is due to the disparity between the standard ambient temperature, 75° F. and what the human senses perceive as ambient food temperature, 98.6° F., namely, body temperature. Preferably, the sorbent generates at least 1.5 times the heat content of the vapor it absorbs or adsorbs.

While the composition of the sorbent determines the ratio between hot and cold gradients, the amount of vaporizable substance in the cooler module will determine, under conditions of constant ambient temperature and insulating conditions, the equilibrium temperatures of each module, and the length of time those temperatures can be maintained.

As shown in FIGS. 1 and 2, the temperature changing device of the present invention may be advantageously adapted to be placed into a food container 60 having separate zones defined by pockets 62, 64 for separate hot and cold food portions. Such containers may be made of foam, paper, cardboard, or plastic, but are preferably made of a biodegradable substance having insulative qualities. The container should be lightweight, inexpensive, non-bulky, and disposable. Preferably, the container includes a top 66 (shown in phantom in FIG. 2) for preventing heat transfer from the hot and cold food portions.

The amount of vaporizable substance required for a specific application is determined empirically. First, the heat required to maintain an enclosure of interest for a fixed length of time is measured by metering the power delivered. Next, this power requirement can be converted to thermal units, such as Btu's or calories, and a quantity of liquid corresponding to that thermal quantity in its latent heat of vaporization is calculated. A quantity of liquid slightly in excess of this will be required in cooler module 12. A corresponding quantity of sorbent, slightly in excess of that required to absorb or adsorb this quantity of liquid, will be necessary in heater module 14.

The limiting equilibrium temperature in heater module 14 is the temperature at which sorbent would react with an equivalent amount of liquid under conditions of perfectly efficient contact. The actual equilibrium temperature is the limiting temperature corrected by a factor for the inefficient delivery of vapor from cooler module 12. The inefficient flow of vapor causes the reaction to persist over a longer length of time and delivers less thermal energy per unit time. Because the supply of vapor is regulated to a reasonably constant rate by the temperature of both the heater 14 and cooler 12 modules in a type of thermal feedback, a constant temperature can be maintained for an extended period of time.

Equilibrium temperatures and their duration will be influenced by the insulation conditions in the cavities enclosing both modules. The examples demonstrate in part the effect of insulation.

The transition time that is required to initiate the flow of vapor and the chemical reactions and to bring the modules to equilibrium temperatures is a function of the design of the apparatus and the thermal properties of its components. In the embodiments described in the examples, transition time is a satisfactorily small factor of total operating time.

The heat required to maintain a closed, empty styrofoam container of dimensions $4.75 \times 4.75 \times 1.75$ and wall thickness 0.070 in. at 56° F. temperature rise for 30 minutes was determined by placing a temperature sensor together with a small electrical heater inside the box, bringing the temperature to 56° F. temperature rise about one hour, and metering the power delivered. Under these conditions, 10 watts, or 31.4 Btu of power was required The sorbent to be used in the heat modules generated 1.8 times the latent heat of vaporization of water; thus a quantity of water having a latent heat of 23 Btu or 10 ml of water in the form of a distributed film of Water Lock Model J550 starch-acrylic polymer (Grain Processing Corporation, Muscatine, Iowa 52761) was placed in cooler module 12. A quantity of 85 grams of Multiform Desiccants, Inc. (Buffalo, N.Y. 14213) type 4A desiccant in 1/16 diameter beads was placed in heater module 14. Both heater 14 and cooler 12 modules were constructed of 0.003 inch thick copper foil sheet in dimensions to fit the styrofoam test cavities. The copper sheet was soldered at the edges to provide an airtight seal. The modules were joined by a conduit of heavy-walled plastic tubing in which a frangible valve in a closed position had been inserted. Both modules were evacuated, reducing the pressure in heater module 14 to a virtual vacuum and that in cooler module 12 to the vapor pressure of water at ambient temperature.

A test of the apparatus was carried out in the open air at 71° F. without insulation. The device was activated by breaking open valve 32 to start the flow of vapor.

After a 5 minute starting transient, the temperature of the cooler module had fallen to 28° F. below ambient, and the temperature of the heater module had increased to 52° F. over ambient. The temperatures were maintained for 45 minutes.

EXAMPLE 2

The test was repeated, under approximately the same conditions as Example 1, but with each of the modules encased in a styrofoam box identical to that described. The temperature of the heater module chamber increased to 134° F. and that of the cooler modules chamber decreased to 44° F. The equilibrium chamber temperatures were maintained for over 30 minutes.

What is claimed is:

1. A disposable container for separate hot and cold portions of food which heats the hot portion and cools the cold portion, comprising:

a tray having a first pocket for the cold food portion and a second pocket for the hot food portion;

a cover suitable for mating with said tray for reducing heat transfer between said pockets;

a first module thermally coupled to said first pocket for cooling the cold food portion, said first module containing a vaporizable substance having a vapor pressure;

a second module thermally coupled to said second pocket for heating the hot food portion, said second module being evacuated and containing a sorbent for said vaporizable substance;

a conduit for establishing a fluid connection between said first and second modules; and a valve in said conduit for selectively allowing flow through said conduit between said modules such that opening said valve to connect said first and second modules permits said vaporizable substance to vaporize, thereby forming a vapor, and permits said vapor to pass through said conduit and into said sorbent, which removes the vapor such that the vaporization of said vaporizable substance serves to cool said cold food portion, and the sorption of said vapor by said sorbent serves to heat said hot food portion.

2. The container of claim 1, wherein said first module comprises a substantially planar sealed envelope.

3. The container of claim 1, wherein said first module comprises a thin-walled envelope that conforms to the shape of a portion of said container.

4. The container of claim 2 or 3, further comprising means for preventing vacuum-driven collapse of said first module.

5. The container of claim 4, wherein said means for preventing collapse comprises a space-filling insert in said first module.

6. The container of claim 4, wherein said means for preventing collapse comprise rigid beads.

7. The container of claim 2 or 3, wherein first and second modules comprise metallic foil.

8. The container of claim 6, wherein said metallic foil comprises aluminum.

9. The container of claim 1, wherein said conduit is a flexible tube.

10. The container of claim 9, wherein said valve is a single-use frangible device.

11. The container according of claim 9, wherein said valve is a partially open frangible sphere.

12. The container of claim 9, wherein said valve is a frangible occlusive membrane.

13. The container of claim 1, wherein said vaporizable material is water incorporated into a gel.

14. The container of claim 13, wherein said gel is formed with a starch-acrylic water-fixing polymer.

15. The container of claim 4, further comprising means for preventing vacuum-driven collapse of said second module.

16. The container of claim 15, wherein said means for preventing collapse of said second module comprise a space-filling insert in said second module.

17. The container of claim 16, wherein said space-filling insert is sorbent material formed into discrete particles.

18. A method of simultaneously heating and cooling adjacent zones, comprising the steps of:

(a) providing a heating and cooling apparatus, comprising:

(1) a container, the interior of which is divided into thermally separated first and second zones;

(2) a first module for cooling the first zone, said first module containing a vaporizable liquid comprising a water-containing gel having a vapor pressure, said water incorporated into a distributed film comprising a starch-acrylic water-fixing polymer having a vapor pressure;

(3) a second module for heating the second zone, wherein said second module is evacuated and contains a sorbent for said vaporizable substance;

(4) a conduit connecting said first and second modules; and (5) a valve in said conduit for selectively allowing flow through said conduit between said modules;

b. opening said valve, thereby connecting said first and second modules, whereby the pressure in said first module is reduced, causing said vaporizable substance to vaporize; and c. removing said vapor from said first module by collecting same in said sorbent, such that the vaporization of said vaporizable substance serves to cool said first module, thereby cooling said first zone, and the sorption of said vapor in said sorbent serves to heat said second module thereby heating said second zone.

19. An apparatus for a simultaneously heating and cooling separate zones, comprising:

a disposable, unitary container, the interior of which is divided into thermally separated first and second zones;

a first module comprising a substantially planar sealed envelope thermally coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module; and means for preventing a vacuum-driven collapse of said first module, wherein said module comprises upper and lower layers and wherein said means for preventing collapse comprise corrugations formed in at least one of said layers, forming channels in said module, wherein said upper and lower layers comprise metallic foil.

20. An apparatus for a simultaneously heating and cooling separate zones, comprising:

a disposable, unitary container, the interior of which is divided into thermally separated first and second zones;

a first module comprising a thin-walled envelope that conforms to the shape of a portion of said container, said first module thermally coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module; and means for preventing a vacuum-driven collapse of said first module, wherein said module comprises upper and lower layers and wherein said means for preventing collapse comprise corrugations formed in at least one of said layers, forming channels oriented to one another in a generally orthogonal relationship in said module, wherein said upper and lower layers comprise metallic foil.

21. An apparatus for a simultaneously heating and cooling separate zones, comprising:

a disposable, unitary container, the interior of which is divided into thermally separated first and second zones;

a first module comprising a substantially planar sealed envelope, said first module thermally coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module; and means for preventing a vacuum-driven collapse of said first module, wherein said module comprises upper and lower layers and wherein said means for preventing collapse comprise corrugations formed in at least one of said layers, forming channels in said module, wherein said upper and lower layers comprise aluminum.

22. An apparatus for a simultaneously heating and cooling separate zones, comprising:

a disposable, unitary container, the interior of which is divided into thermally separated first and second zones;

a first module comprising a thin-walled envelope that conforms to the shape of a portion of said container, said first module thermally coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module; and means for preventing a vacuum-driven collapse of said first module, wherein said module comprises upper and lower layers and wherein said means for preventing collapse comprise corrugations formed in at least one of said layers, forming channels oriented to one another in a generally orthogonal relationship in aid module, wherein said upper and lower layers comprise aluminum.

23. An apparatus for a simultaneously heating and cooling separate zones, comprising:

a disposable, unitary container, the interior of which is divided into thermally separated first and second zones;

a first module comprising a substantially planar sealed envelope, said first module thermally coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module; and means for preventing a vacuum-driven collapse of said first module, wherein said module comprises upper and lower layers comprising metallic foil and a layer of plastic material, and wherein said means for preventing collapse comprise corrugations formed in at least one of said layers, forming channels in said module.

24. An apparatus for a simultaneously heating and cooling separate zones, comprising:

a disposable, unitary container, the interior of which is divided into thermally separated first and second zones:

a first module comprising a thin-walled envelope that conforms to the shape of a portion of said container, thermally, said first module coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module; and means for preventing a vacuum-driven collapse of said first module, wherein said module comprises upper and lower layers comprising aluminum foil and a layer of plastic material, and wherein said means for preventing collapse comprise corrugations formed in at least one of said layers, forming channels in said module.

25. An apparatus for a simultaneously heating and cooling separate zones, comprising:

a disposable, unitary container, the interior of which is divided into thermally separated first and second zones;

a first module comprising a thin-walled envelope that conforms to the shape of a portion of said container, said first module thermally coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module; and means for preventing a vacuum-driven collapse of said first module, wherein said module comprises upper and lower layers and wherein said means for preventing collapse comprise corrugations formed in at least one of said layers, forming channels in said module, wherein said upper and lower layers comprise metallic foil.

26. An apparatus for a simultaneously heating and cooling separate zones, comprising:

a disposable, unitary container, the interior of which is divided into thermally separated first and second zones;

a first module comprising a substantially planar sealed envelope, said first module thermally coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module; and means for preventing a vacuum-driven collapse of said first module, wherein said module comprises upper and lower layers and wherein said means for preventing collapse comprise corrugations formed in at least one of said layers, forming channels oriented to one another in a generally orthogonal relationship in said module, wherein said upper and lower layers comprise metallic foil.

27. An apparatus for a simultaneously heating and cooling separate zones, comprising:

a disposable, unitary container, the interior of which is divided into thermally separated first and second zones;

a first module comprising a thin-walled envelope that conforms to the shape of a portion of said container, said first module thermally coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module; and means for preventing a vacuum-driven collapse of said first module, wherein said module comprises upper and lower layers and wherein said means for preventing collapse comprise corrugations formed in at least one of said layers, forming channels in said module, wherein said upper and lower layers comprise aluminum.

28. An apparatus for a simultaneously heating and cooling separate zones, comprising:

a disposable, unitary container, the interior of which is divided into thermally separated first and second zones;

a first module comprising a substantially planar sealed envelope, said first module thermally coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module; and means for preventing a vacuum-driven collapse of said first module, wherein said module comprises upper and lower layers and wherein said means for preventing collapse comprise corrugations formed in at least one of said layers, forming channels oriented to one another in a generally orthogonal relationship in said module, wherein said upper and lower layers comprise aluminum.

29. An apparatus for a simultaneously heating and cooling separate zones, comprising:

a disposable, unitary container, the interior of which is divided into thermally separated first and second zones;

a first module comprising a thin-walled envelope that conforms to the shape of a portion of said container, thermally, said first module coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module; and means for preventing a vacuum-driven collapse of said first module, wherein said module comprises upper and lower layers comprising metallic foil and a layer of plastic material, and wherein said means for preventing collapse comprise corrugations formed in at least one of said layers, forming channels in said module, said channels oriented to one another in a generally orthogonal relationship.

30. An apparatus for a simultaneously heating and cooling separate zones, comprising:

a disposable, unitary container, the interior of which is divided into thermally separated first and second zones;

a first module comprising a substantially planar sealed envelope, said first module thermally coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module; and means for preventing vacuum-driven collapse of said first module, wherein said module comprises upper and lower layers comprising aluminum and a layer of plastic material, and wherein said means for preventing collapse comprise corrugations formed in at least one of said layers, forming channels in said module, said channels oriented to one another in a generally orthogonal relationship.

31. An apparatus for a simultaneously heating and cooling separate zones, comprising:

a disposable, unitary container, the interior of which is divided into thermally separated first and second zones;

a first module comprising a substantially planar sealed envelope, said first module thermally coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module; and means for preventing vacuum-driven collapse of said first module comprising rigid beads.

32. An apparatus for a simultaneously heating and cooling separate zones, comprising:

a disposable, unitary container, the interior of which is divided into thermally separated first and second zones;

a first module comprising a thin-walled envelope that conforms to the shape of the portion of said container, said first module thermally coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module; and means for preventing vacuum-driven collapse of said first module comprising rigid beads.

33. An apparatus for a simultaneously heating and cooling separate zones, comprising:

a disposable, unitary container, the interior of which is divided into thermally separated first and second zones;

a first module comprising a substantially planar sealed envelope, said first module thermally coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module, said valve comprising a partially open frangible sphere; and means for preventing a vacuum-driven collapse of said first module, wherein said module comprises upper and lower layers and wherein said means for preventing collapse comprise corrugations formed in at least one of said layers, forming channels in said module, wherein said upper and lower layers comprise aluminum.

34. An apparatus for a simultaneously heating and cooling separate zones, comprising:

a disposable, unitary container, the interior of which is divided into thermally separated first and second zones:

a first module comprising a thin-walled envelope that conforms to the shape of a portion of said container, said first module thermally coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module, said valve comprising a partially open frangible sphere; and means for preventing a vacuum-driven collapse of said first module, wherein said module comprises upper and lower layers and wherein said means for preventing collapse comprise corrugations formed in at least one of said layers, forming channels in said module, wherein said upper and lower layers comprise aluminum.

35. An apparatus for a simultaneously heating and cooling separate zones, comprising:

a disposable, unitary container, the interior of which is divided into thermally separated first and second zones;

a first module comprising a substantially planar sealed envelope, said first module thermally coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module, said valve comprising a partially open frangible sphere; and means for preventing a vacuum-driven collapse of said first module, wherein said module comprises upper and lower layers and wherein said means for preventing collapse comprise corrugations formed in at least one of said layers, forming channels oriented to one another in a generally orthogonal relationship in said module, wherein said upper and lower layers comprise aluminum.

36. An apparatus for a simultaneously heating and cooling separate zones, comprising:

a disposable, unitary container, the interior of which is divided into thermally separated first and second zones;

a first module comprising a thin-walled envelope that conforms to the shape of a portion of said container, said first module thermally coupled to said first zone for cooling said first zone, said first module containing a vaporizable substance having a vapor pressure;

a second module thermally coupled to said second zone for heating said second zone, said second module being evacuated and containing a sorbent for said vaporizable substance;

a conduit for establishing a fluid connection between said first and second module;

a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the evaporation of said vaporizable substance serves to cool said first module, and the sorption of said vapor by said sorbent serves to heat said second module, said valve comprising a partially open frangible sphere; and means for preventing a vacuum-driven collapse of said first module, wherein said module comprises upper and lower layers and wherein said means for preventing collapse comprise corrugations formed in an least one of said layers, forming channels oriented to one another in a generally orthogonal relationship in said module, wherein said upper and lower layers comprise aluminum.

37. A method of simultaneously heating and cooling adjacent zones, comprising the steps of:

a. providing a heating and cooling apparatus, comprising:

(1) a disposable, unitary container, the interior of which is divided into thermally separated first and second zones;

(2) a first module for cooling the first zone, said first module containing water incorporated into a gel, said water having a vapor pressure;

(3) a second module for heating the second zone, wherein said second module is evacuated and contains a sorbent for said water;

(4) a conduit connecting said first and second module; and 5) a valve in said conduit for selectively allowing flow through said conduit between said modules;

b. opening said valve, thereby connecting said first and second modules, whereby the pressure in said first module is reduced, causing said water to vaporize; and c. removing said vapor from said first module by collecting same in said sorbent, such that the vaporization of said water serves to cool said first module, and the sorption of said vapor in said sorbent serves to heat said second module thereby heating said second zone.

38. A method of simultaneously heating and cooling adjacent zones, comprising the steps of:

a. providing a heating and cooling apparatus, comprising:

(1) a disposable, unitary container, the interior of which is divided into thermally separated first and second zones;

(2) a first module for cooling the first zone, said first module containing water incorporated into a distributed film by means of a starch-acrylic water-fixing polymer having a vapor pressure;

(3) a second module for heating the second zone, wherein said second module is evacuated and contains a sorbent for said water;

(4) a conduit connecting said first and second module; and (5) a valve in said conduit for selectively allowing flow through said conduit between said modules;

b. opening said valve, thereby connecting said first and second modules, whereby the pressure in said first module is reduced, causing said water to vaporize; and c. removing said vapor from said first module by collecting same in said sorbent, such that the vaporization of said water serves to cool said first module, and the sorption of said vapor in said sorbent serves to heat said second module thereby heating said second zone.

39. An apparatus for simultaneously heating and cooling separate zones, comprising:

a container divided into first and second zones;

a first module thermally coupled to said first zone for cooling said first zone, said first module containing a vaporizable liquid comprising a gel, said gel comprising a starch-acrylic water-fixing polymer having a vapor pressure;

a second module thermally coupled to said second zone for heating said second zone, said second module being evacuated and containing a sorbent for said vaporizable substance;

a conduit for establishing a fluid connection between said first and second modules; and a valve in said conduit for selectively allowing flow through said conduit between said modules such that opening said valve to connect said first and second modules permits said vaporizable substance to vaporize, thereby forming a vapor, and permits said vapor to pass through said conduit and into contact with said sorbent, which sorbs and removes said vapor such that the vaporization of said vaporizable substance serves to cool said first module, and the sorption of said vapor by said sorbent serves to heat said second module.

* * * * *